US006691778B2

(12) United States Patent
Cole et al.

(10) Patent No.: US 6,691,778 B2
(45) Date of Patent: Feb. 17, 2004

(54) METHODS OF PERFORMING DOWNHOLE OPERATIONS USING ORBITAL VIBRATOR ENERGY SOURCES

(75) Inventors: Jack H. Cole, Fayetteville, AR (US); David M. Weinberg, Idaho Falls, ID (US); Dennis R. Wilson, Katy, TX (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 161 days.

(21) Appl. No.: 10/003,638

(22) Filed: Nov. 2, 2001

(65) Prior Publication Data

US 2002/0104652 A1 Aug. 8, 2002

Related U.S. Application Data

(60) Provisional application No. 60/245,910, filed on Nov. 3, 2000.

(51) Int. Cl.[7] ..... E21B 28/00

(52) U.S. Cl. ..... 166/249; 166/301; 166/285; 166/177.6

(58) Field of Search ..... 166/301, 177.2, 166/177.6, 249, 281, 285; 175/56

(56) References Cited

U.S. PATENT DOCUMENTS

| | | | | |
|---|---|---|---|---|
| 3,578,081 A | * | 5/1971 | Bodine | 166/249 |
| 4,236,580 A | | 12/1980 | Bodine | |
| 4,280,557 A | | 7/1981 | Bodine | 166/177 |
| 4,512,401 A | | 4/1985 | Bodine | 166/249 |
| 4,640,360 A | | 2/1987 | Bodine et al. | |
| 4,658,897 A | | 4/1987 | Kompanek et al. | |
| 4,667,742 A | | 5/1987 | Bodine | 166/301 |
| 4,673,037 A | | 6/1987 | Bodine | |
| 4,815,328 A | | 3/1989 | Bodine | |
| 4,824,258 A | | 4/1989 | Bodine | |
| 4,874,061 A | | 10/1989 | Cole | 181/106 |
| 4,913,234 A | | 4/1990 | Bodine | 166/301 |
| 5,121,363 A | | 6/1992 | Benzing | |
| 5,159,160 A | | 10/1992 | Brett | |
| 5,229,552 A | | 7/1993 | Cole | |
| 5,229,554 A | | 7/1993 | Cole | |
| 5,234,056 A | | 8/1993 | Bodine et al. | |
| 5,321,213 A | | 6/1994 | Cole et al. | |
| 5,515,918 A | * | 5/1996 | Brett et al. | 166/249 |
| 5,595,243 A | | 1/1997 | Maki, Jr. et al. | 166/177.2 |
| 6,009,948 A | * | 1/2000 | Flanders et al. | 166/301 |

* cited by examiner

*Primary Examiner*—Frank Tsay

(57) ABSTRACT

Methods of performing down hole operations in a wellbore. A vibrational source is positioned within a tubular member such that an annulus is formed between the vibrational source and an interior surface of the tubular member. A fluid medium, such as high bulk modulus drilling mud, is disposed within the annulus. The vibrational source forms a fluid coupling with the tubular member through the fluid medium to transfer vibrational energy to the tubular member. The vibrational energy may be used, for example, to free a stuck tubular, consolidate a cement slurry and/or detect voids within a cement slurry prior to the curing thereof.

26 Claims, 7 Drawing Sheets

METHODS OF PERFORMING DOWNHOLE OPERATIONS USING ORBITAL VIBRATOR ENERGY SOURCES

RELATED APPLICATION

This application claims priority to U.S. Patent Application Ser. No. 60/245,910 filed Nov. 3, 2000 and is incorporated herein.

CONTRACTUAL ORIGIN OF THE INVENTION

This invention was made with United States Government support under Contract No. DE-AC07-94ID13223, now Contract No. DE-AC07-99ID13727 awarded by the United States Department of Energy. The United States Government has certain rights in this invention.

BACKGROUND OF THE INVENTION

1. Field of the Invention

The present invention relates generally to down hole operations performed in wellbores and, more particularly, to the use of a vibrational source, such as an orbital mass vibrator, for performing such down hole operations.

2. State of the Art

Boreholes or wellbores are conventionally drilled from surface locations into hydrocarbon-bearing subterranean geological formations in order to obtain hydrocarbons such as oil and gas.

Often, during the drilling of a wellbore, the drill pipe utilized for drilling the wellbore gets stuck down hole, frequently at great distances from the surface location. Additionally, during completion, production and workover of the wellbores, tubing and various devices carried thereby get stuck that must be retrieved from the wellbore. In many cases the stuck object must be freed so as to further deploy the object within the wellbore, or so as to retrieve the object from the wellbore and continue with the attendant drilling, completion, production or workover operation.

A variety of methods have been utilized to free and retrieve stuck objects in wellbores in the oil and gas industry. For example, U.S. Pat. Nos. 4,913,234 and 4,667,742 issued to Bodine disclose the deployment of an orbital mass vibrator down hole to free a stuck pipe in a wellbore. The orbital vibrator of the 4,667,742 patent is mechanically coupled to an upper end of the stuck pipe in order to transfer vibrational energy thereto.

The orbital vibrator of the 4,913,234 patent likewise transfers energy to the stuck pipe in an effort to free it from the wellbore. However, the 4,913,234 patent teaches the transfer of energy by rotating the orbital vibrator precessionally around the inside wall of the of the stuck pipe. Thus, both of the above Bodine patents describe a process of freeing a stuck pipe which includes physical contact of the orbital vibrator with the stuck member.

Other operations performed in preparing a wellbore for the production of hydrocarbons likewise benefit from the use of a vibrational energy source. For example, upon deployment of a liner, or a tubular string down the well bore, cement is pumped down hole to fill the space (annulus) between the liner and the wellbore wall. During disposition of cement into the annulus, the liner may be vibrated to fill any voids or channels in the annulus, consolidate the cement and to generally improve the integrity of the cement bond between the liner and the wellbore. Other methods of removing voids in the cement have included deploying a down hole vibrational source during disposition of cement into the annulus.

For example, U.S. Pat. No. 5,515,918 to Brett et al. discloses deployment of an orbital mass vibrator down hole for transferring vibrational energy to a cement slurry. The 5,515,918 patent describes a vibrator which rotates a mass about a longitudinal axis in one direction to induce a backward "whirl" of the mass in the opposite direction. However, the backward whirl of the orbital vibrator includes the mass contacting and precessionally rotating about the interior of the liner or other tubular in which the vibrator is disposed. Such contact may be undesirable in that inadvertent damage may occur to the liner or other tubular string.

U.S. Pat. No. 4,658,897 issued to Kompanek et al. discloses another method of inducing vibrational energy to a cement slurry. The 4,658,897 patent teaches the down hole deployment of a transducer system for transferring vibrational energy to the cement slurry. The transducer is drawn upwardly through the bore hole to eliminate pockets or voids in the slurry. However, such a method fails to teach the identification and isolation of voids or pockets within the cement slurry.

U.S. Pat. No. 6,009,948 issued to Flanders et al. discloses the use of a vibratory source for either freeing a stuck pipe or other object from the well bore or for aiding in cementing operations. The vibratory tool is deployed down hole and is engaged with an object to transfer vibrational energy thereto. With regard to freeing stuck pipes, the vibratory tool is stated to determine the optimum frequency (i.e., resonance) and the operate at that frequency. However, as noted above, the 6,009,948 patent still teaches the physical engagement or coupling of the vibratory source with the stuck pipe or object. Such physical coupling with the pipe or other object for purposes or transferring vibrational energy thereto (or therethrough) may result in unwanted stresses or strains in the pipe or object and may ultimately result in damage incurred by the object to which the vibrator is coupled.

In view of the shortcomings in the art, it would be advantageous to provide an apparatus and method for transferring vibrational energy to specific locations in the wellbore in association with performing various down hole operations. For example, it would be advantageous to provide an apparatus and method which allowed the freeing of stuck tubulars or like objects without mechanically and physically coupling the vibrational source to the stuck object.

Likewise, it would be advantageous to provide an apparatus and method for identifying specific locations of voids or pockets in a cement slurry, and then applying appropriate levels of vibrational energy to those locations for removal of such voids or pockets.

BRIEF SUMMARY OF THE INVENTION

In accordance with one aspect of the invention, a method of inducing vibrational energy in a tubular member is provided. The method includes deploying a vibrational source within an interior portion of the tubular member. A fluid medium is disposed within an annulus formed between the vibrational source and an interior surface of the tubular member. The vibrational source is operated using the fluid medium to create a fluid coupling between the vibrational source and the tubular member. The fluid medium may be a fluid already present in the tubular member, such as, for example, drilling mud. Alternatively the fluid medium may be disposed in the tubular member specifically for the particular task of forming a fluid coupling with the tubular member.

In accordance with another aspect of the present invention, a method of freeing a stuck tubular from a wellbore is provided. The method includes disposing a vibrational source within the stuck tubular adjacent a point of sticking. A fluid coupling is formed between the vibrational source and the stock tubular using a fluid medium disposed within the stuck tubular to transfer vibrational energy from the vibrational source to the stuck tubular and reducing friction between the stuck tubular and the wellbore.

In accordance with another aspect of the present invention, a method is provided for cementing a wellbore. The method includes inserting a tubular member within the well bore so as to define a first outer annulus between the wellbore wall and an exterior surface of the tubular member and cement slurry is disposed into the first outer annulus. A vibrational source is disposed within the tubular member so as to define a second inner annulus between an exterior portion of the vibrational source and an interior surface of the tubular member. A fluid coupling is formed between the vibrational source and the tubular member using a fluid medium disposed in the second annulus to transfer vibrational energy to and through the tubular member and into the cement slurry disposed in the first outer annulus.

DESCRIPTION OF THE DRAWINGS

The foregoing and other advantages of the invention will become apparent upon reading the following detailed description and upon reference to the drawings in which.

DETAILED DESCRIPTION OF THE INVENTION

Figure 1:
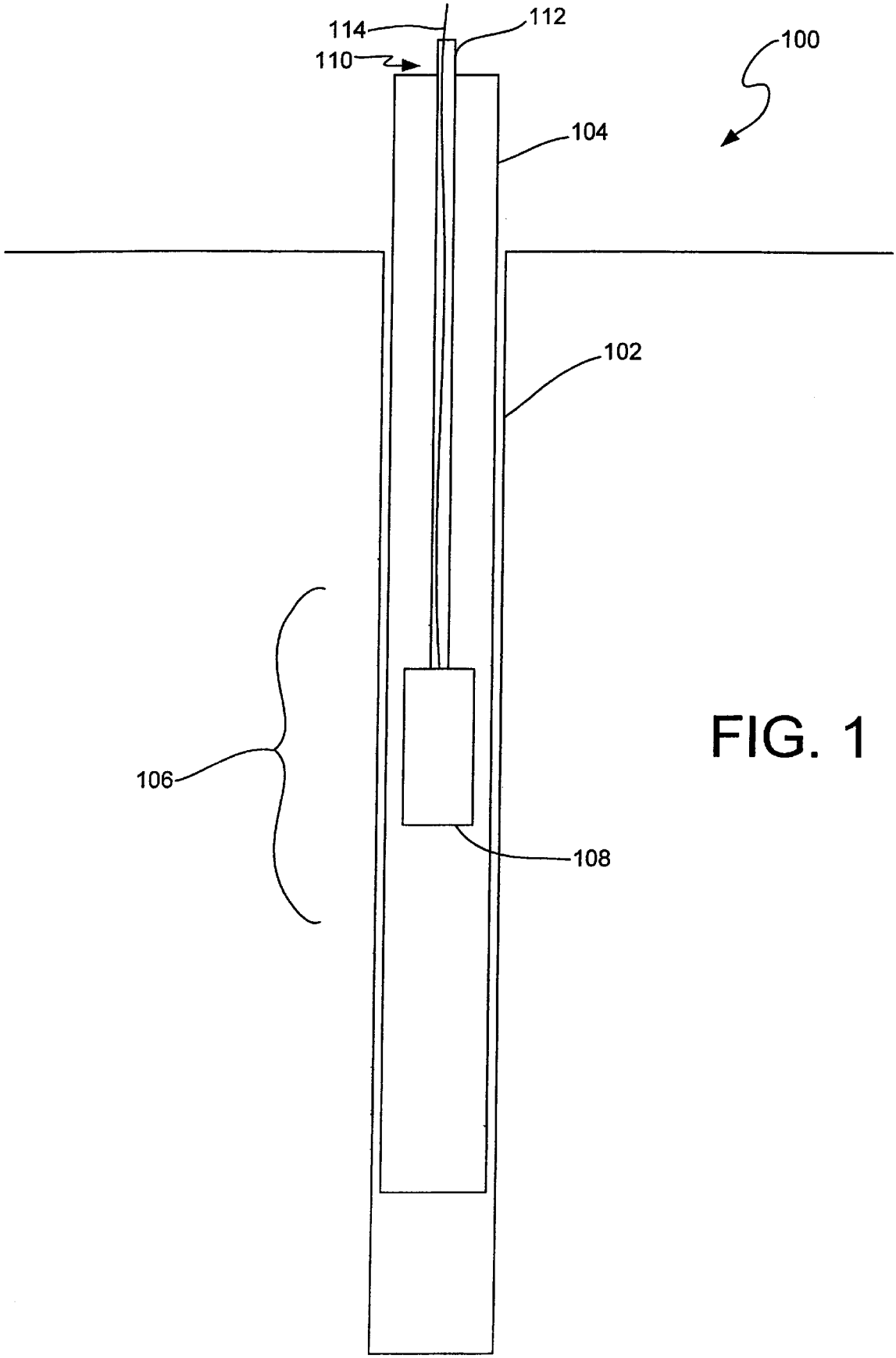
FIG. 1 is a schematic representation of one embodiment of the present invention.

Referring to FIG. 1, a wellbore assembly 100 is shown having a tubular member 104 disposed in a wellbore 102. The tubular member 104 is stuck at a location 106 because of an obstruction in the wellbore 102 or due to increased friction between contacting surfaces of the wellbore 102 and the tubular member 104. It is noted that actual contact of the tubular member 104 with the wellbore 102 is not shown in FIG. 1 for purposes of clarity, rather the general area of sticking is indicated. The location 106 at which the tubular member 104 is stuck may be determined by techniques understood by those of ordinary skill in the art.

It is noted that the tubular member 104 may be any of a number of devices used in preparing and completing a wellbore 102 for production. For example, the tubular member 104 may be a drill string, a liner member, a casing member a tubing member or the like.

It is further noted that, while not shown, the wellbore assembly 100 may include a number of devices and structures well known by those of ordinary skill in the art. Such devices and structures may include, for example, a drilling platform, a drilling rig including a rig mast, pumps, and various control units.

A vibrational source 108, such as an orbital mass vibrator, is placed down the interior of the tubular member 104 in an area proximate and desirably immediately adjacent to the location of sticking 106. The vibrational source 108 may be deployed down hole by an umbilical member 110 which may include an appropriately sized and configured structural member 112, such as, for example, a tubing string to support and position the orbital mass vibrator 108 and a wireline 114, such as, for example, a seven conductor wireline, electrically coupled with the vibrational source 108 to provide power thereto and communicate therewith. It is noted, however, that the vibrational source 108 need not be electrically powered, but rather may be hydraulically or pneumatically powered, as may be appropriate for specific applications.

Figure 2:
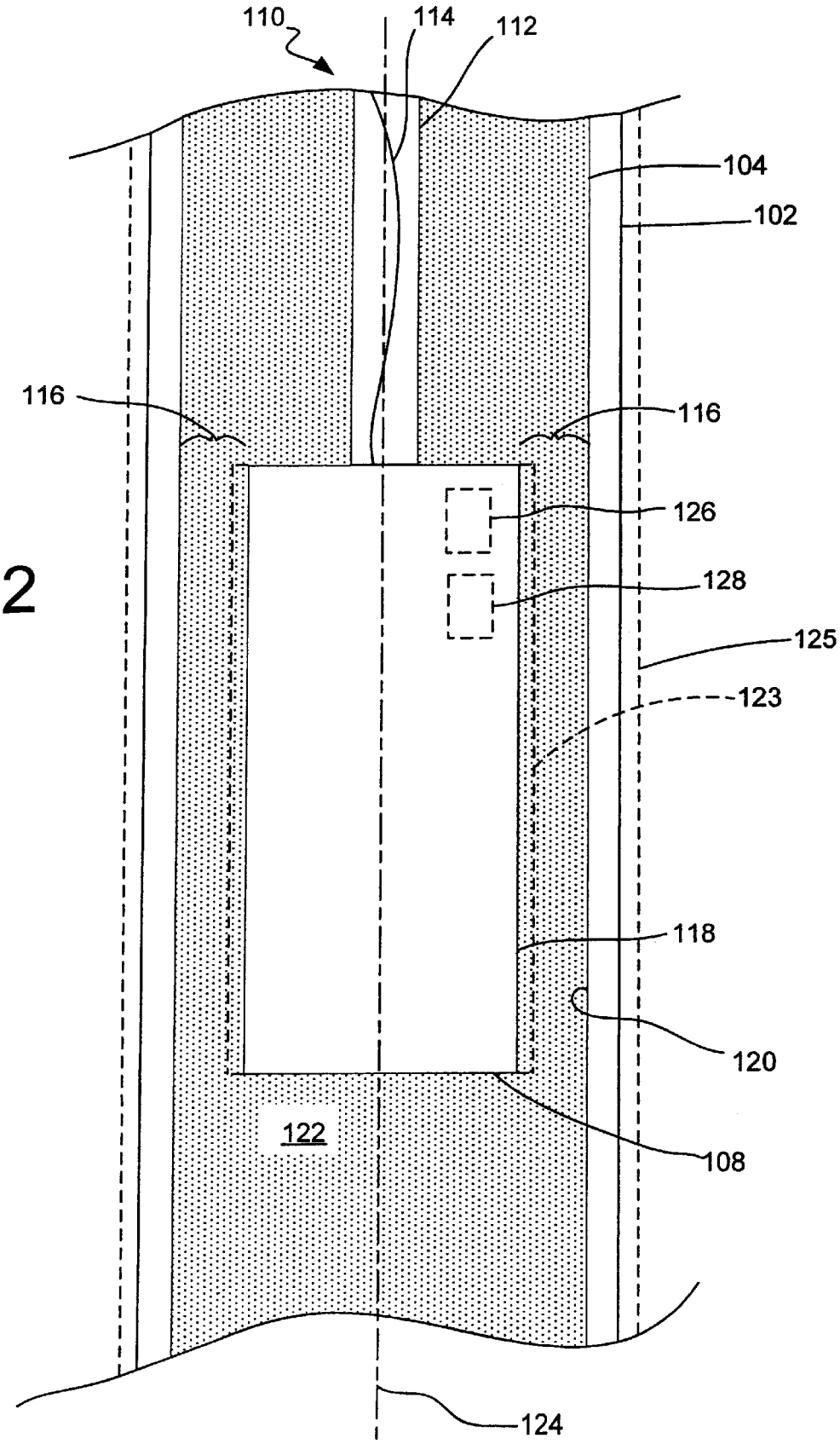
FIG. 2 is an enlarged view of a portion of FIG. 1.

Referring to FIG. 2, an enlarged view of the vibrational source 108 deployed within the tubular member 104 is shown. The outer periphery or diameter of the vibrational source 108 is small enough to fit within the tubular member 104 without interference such that an annulus 116 is formed between the exterior portion 118 of the vibrational source 108 and the interior surface 120 of the tubular member 104. The tubular member 104, including the annulus 116, is filled with a fluid medium 122 such as drilling mud. The fluid medium 122 desirably exhibits a high bulk modulus (e.g., greater than 100,000 psi). The vibrational source 108 produces a vibrational motion (indicated by dashed lines 123 and exaggerated for purposes of illustration) about a longitudinal centerline 124 of the vibrational source 108 at frequencies ranging, for example, from 50 Hertz to several thousand Hertz. An effective fluid coupling is created between the vibrational source 108 and tubular member 104 through the fluid medium 122, thereby transferring vibrational energy to the tubular member 104.

Thus, for example, when using an orbital type vibrator as the vibrational source 108, the fluid coupling will cause the tubular member 104 to orbit about the longitudinal centerline 124 at the same frequency at which the vibrational source 108 is operating as is indicated by dashed lines 125 which are exaggerated for purposes of clarity. While the motion amplitude of the tubular member 104 is small (and thus the stresses and strains imposed on the tubular member are likewise small), the energy transfer is substantial. Such transfer of vibrational energy greatly reduces the friction between the tubular member 104 and the wall of the wellbore 102. Additionally, the fluid coupling allows the efficient application of vibrational energy to a specific location without direct mechanical, or rigid, contact between the vibrational source 108 (or an associated component thereof) with the tubular member 104 which might cause localized stress or strain resulting in damage of the tubular member 104. Additionally, while the vibrational source 108 is positioned and configured to concentrate vibrational energy to the location of sticking 106 (FIG. 1), the motion of the tubular member 104 will propagate longitudinally therethrough, inducing vibrations along a length thereof. Thus, while the maximum amplitude of vibrational energy may be directed at a particular point of application, the vibrational source will be effective in reducing friction along a measurable length of the tubular member 104.

A motion sensor 126, such as a radio accelerometer, may be carried by the vibrational source to sense motion amplitude of the vibrational source 108. Other sensors 128, such as, for example, a pressure transducer may also be carried by the vibrational source 108, or alternatively positioned within the annulus 116, to indicate the strength of the fluid coupling obtained between the vibrational source 108 and the tubular member 104 through the fluid medium 122 and the magnitude of transferred energy.

Figure 3:
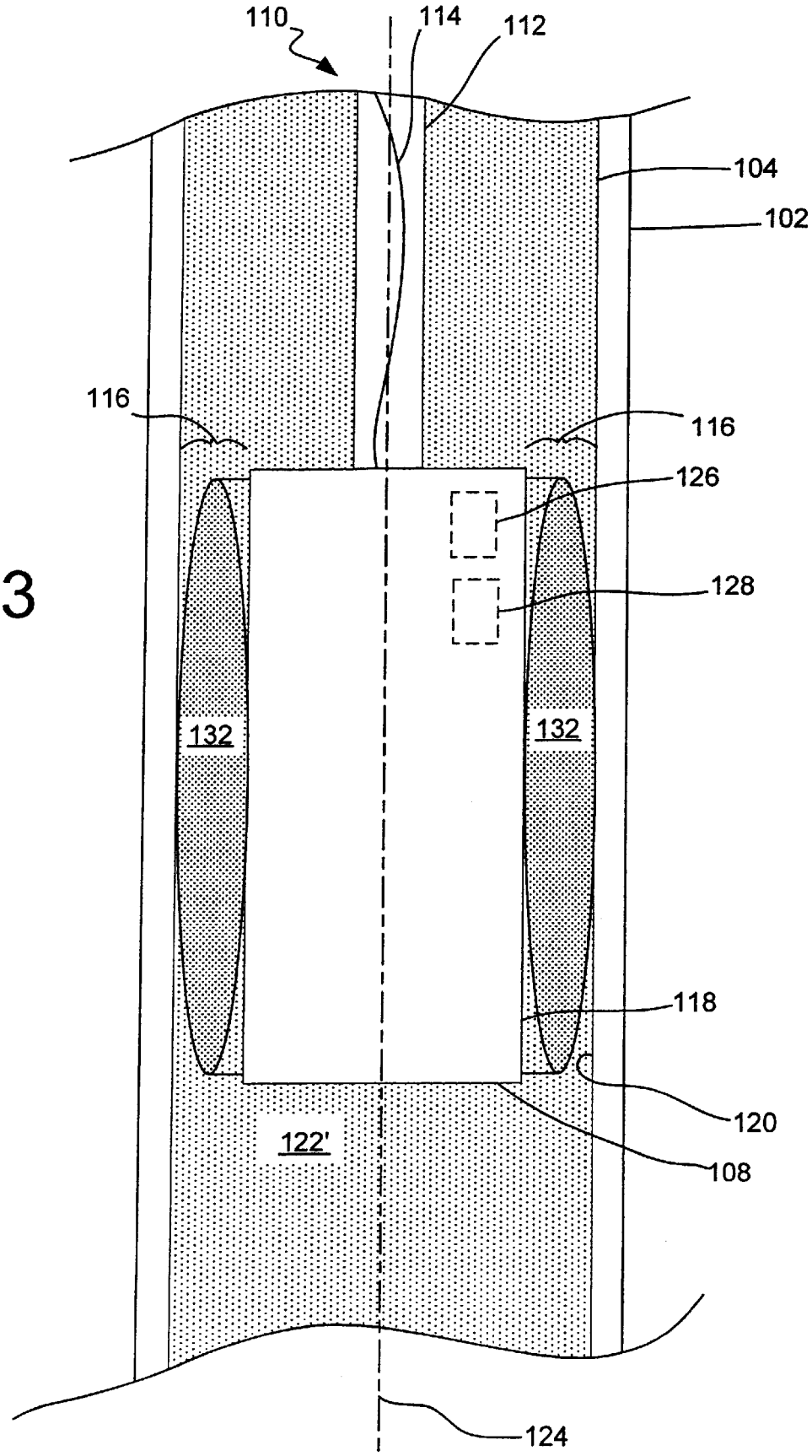
FIG. 3 is an enlarged view of a portion of FIG. 1 according to an alternative embodiment.

Referring now to FIG. 3, an enlarged view of the vibrational source 108 deployed within the tubular member 104 is shown in accordance with another embodiment of the present invention. In some applications, the fluid medium 122' resident within the wellbore annulus 116 may not exhibit a sufficient bulk modulus to allow for a fluid coupling to be achieved between the vibrational source 108 and tubular member 104. In such cases, it may be desirable to place a bladder 130 within the annulus 116 between the vibrational source 108 and the tubular member 104. With the bladder 130 in place, the bladder may be filled with another fluid medium 132, for example, glycerin, having a sufficient bulk modulus to allow for a fluid coupling to be achieved. The bladder 130 is desirably filled so as to expand and contact a substantial circumferential and longitudinal area of the exterior portion 118 of the vibrational source 108 and a corresponding interior surface of the tubular member 104. Thus, a fluid coupling may be established to transfer vibrational energy between the vibrational source 108 and the tubular member 104 even if a fluid medium having a sufficient bulk modulus is not otherwise present within the tubular member 104.

Various vibrational sources may be used to achieve the fluid coupling with a fluid medium. Such vibrational sources may include, for example, rotating eccentric weights, electromagnetic, magnetostrictive or piezoelectric vibrators. Some exemplary vibrational sources include those described in U.S. Pat. Nos. 5,229,554, 5,229,552 4,874,061 all issued to Cole, the disclosures of each of which patents is incorporated by reference herein, U.S. Pat. No. 5,321,213 issued to Cole et al., the disclosure of which is incorporated by reference herein and U.S. Pat. No. 5,121,363 issued to Benzing, the disclosure of which is also incorporated by reference herein. The vibrational sources disclosed in the above mentioned Cole, Cole et al. and Benzing patents generally include orbital mass vibrators and the disclosures therein teach the use of such orbital mass vibrators as seismic sources for use in detecting formation properties.

Figure 4:
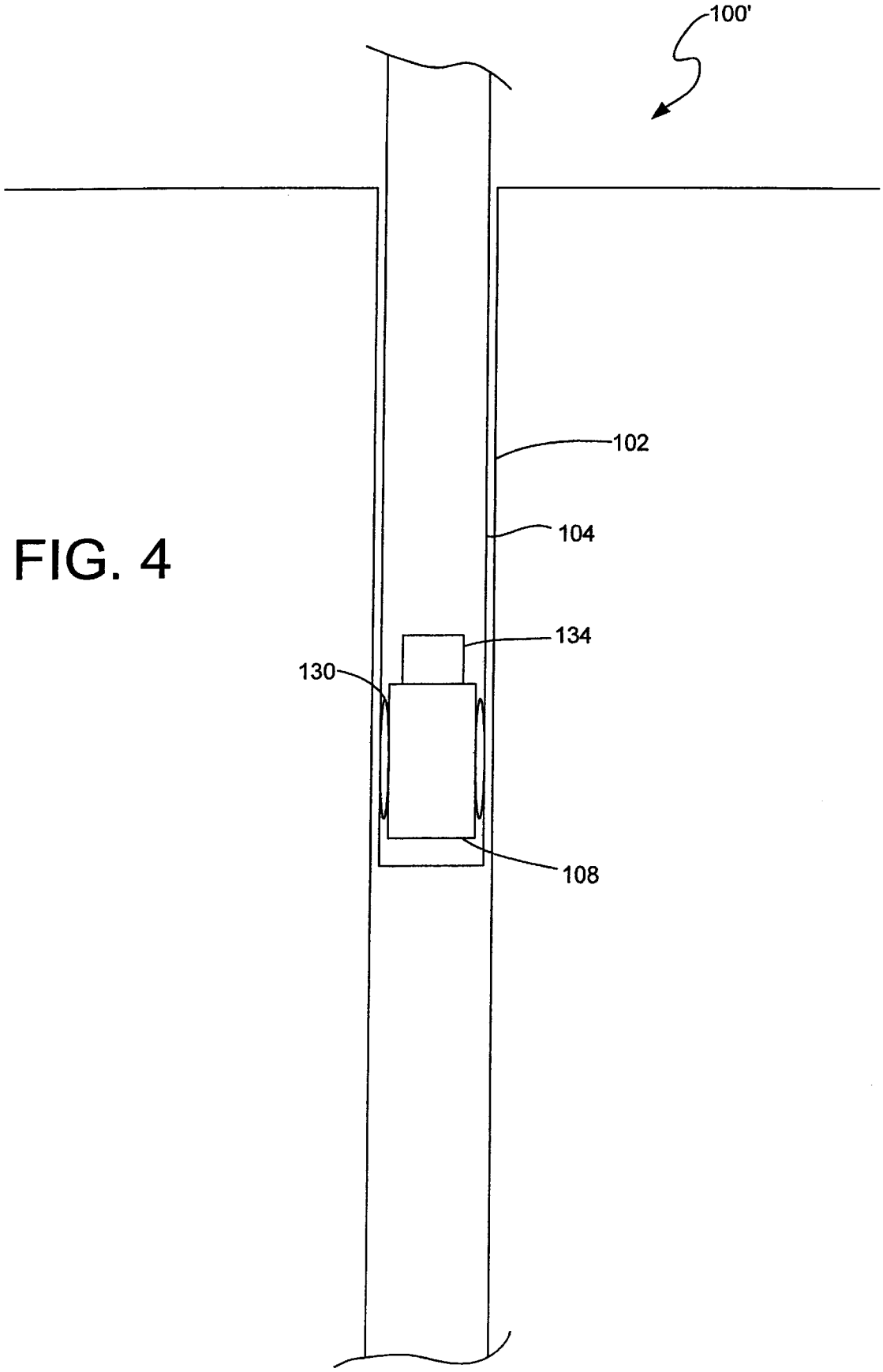
FIG. 4 is a schematic representation of another embodiment of the present invention.

Referring now to FIG. 4, a wellbore assembly 100' incorporating another embodiment of the present invention is shown. The wellbore assembly 100' again includes a tubular member 104 disposed in a wellbore 102. At or near the distal end of the tubular member 104 (although other locations may be acceptable) is a vibrational source 108 which may be fluidly coupled to the tubular member 104 through an inflatable bladder 130 filled with a liquid material having a relatively high bulk modulus. A power pack 134, such as a high energy density battery, is coupled with the vibrational source 108 providing power thereto. The vibrational source 108 may be configured to be controlled, (e.g., turned on and off, frequency changed, etc.) from the surface of the drilling operation 100' through remote wireless telemetry. For example, the vibrational source may be turned on and off by a coded pressure pulse from the rig floor (not shown) through drilling fluid in the wellbore 102 or through an elastic wave signal sent through the tubular member 104. Of course other telemetry devices and techniques may be used as will be recognized by those of ordinary skill in the art.

With the vibrational source 108 and power pack 134 installed, the tubular member 104 may be inserted into the wellbore 102 and the vibrational source 108 may be selectively operated at any point of resistance or increased friction. Alternatively, the vibrational source 108 may be operated continually while the tubular member 104 is being installed within the wellbore 102. Thus, a vibrational source may deployed down hole to perform various operations without the need of an umbilical 110 (FIG. 1) thus allowing greater flexibility in the performance of such down hole operations.

Figure 5A:
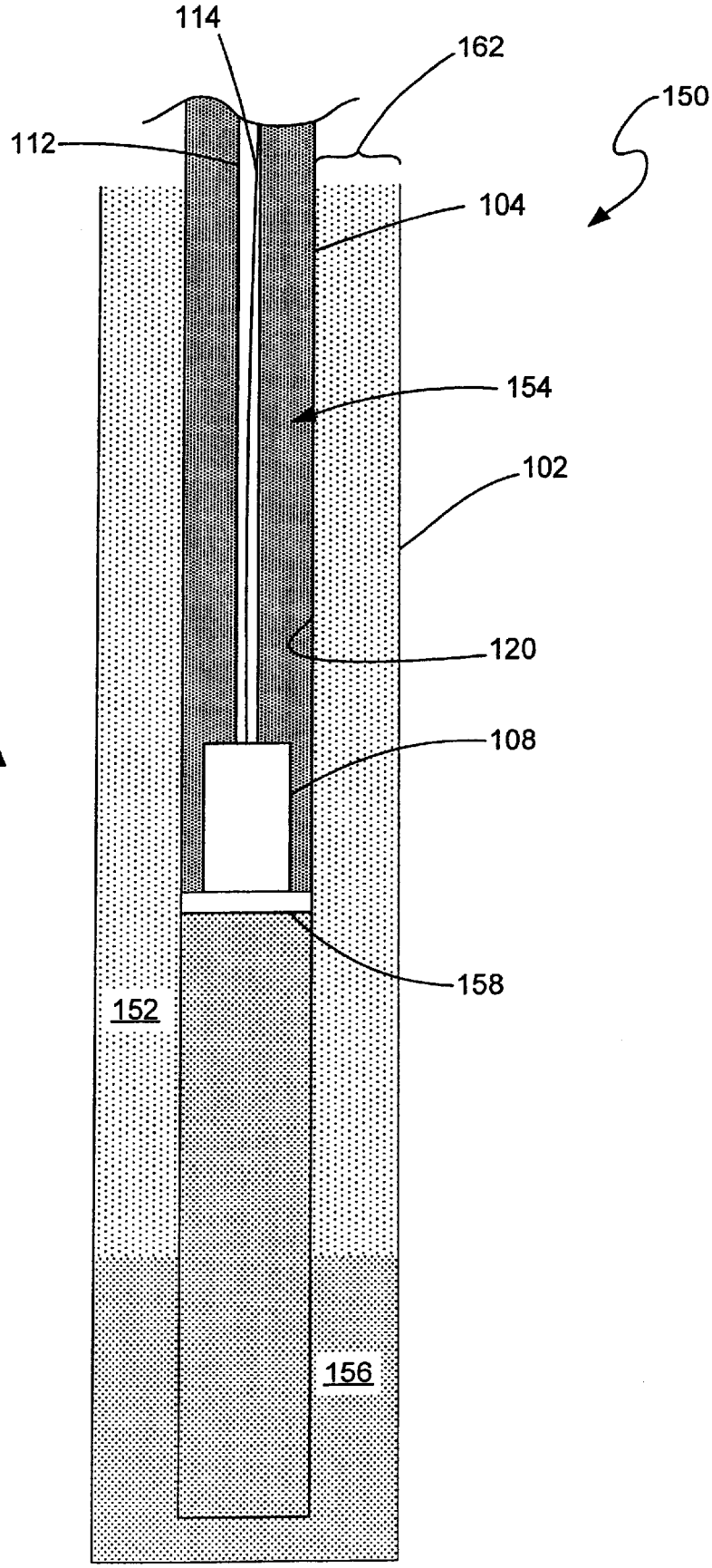
FIGS. 5A through 5C are schematic representations of another embodiment of the present invention.
Figure 5B:
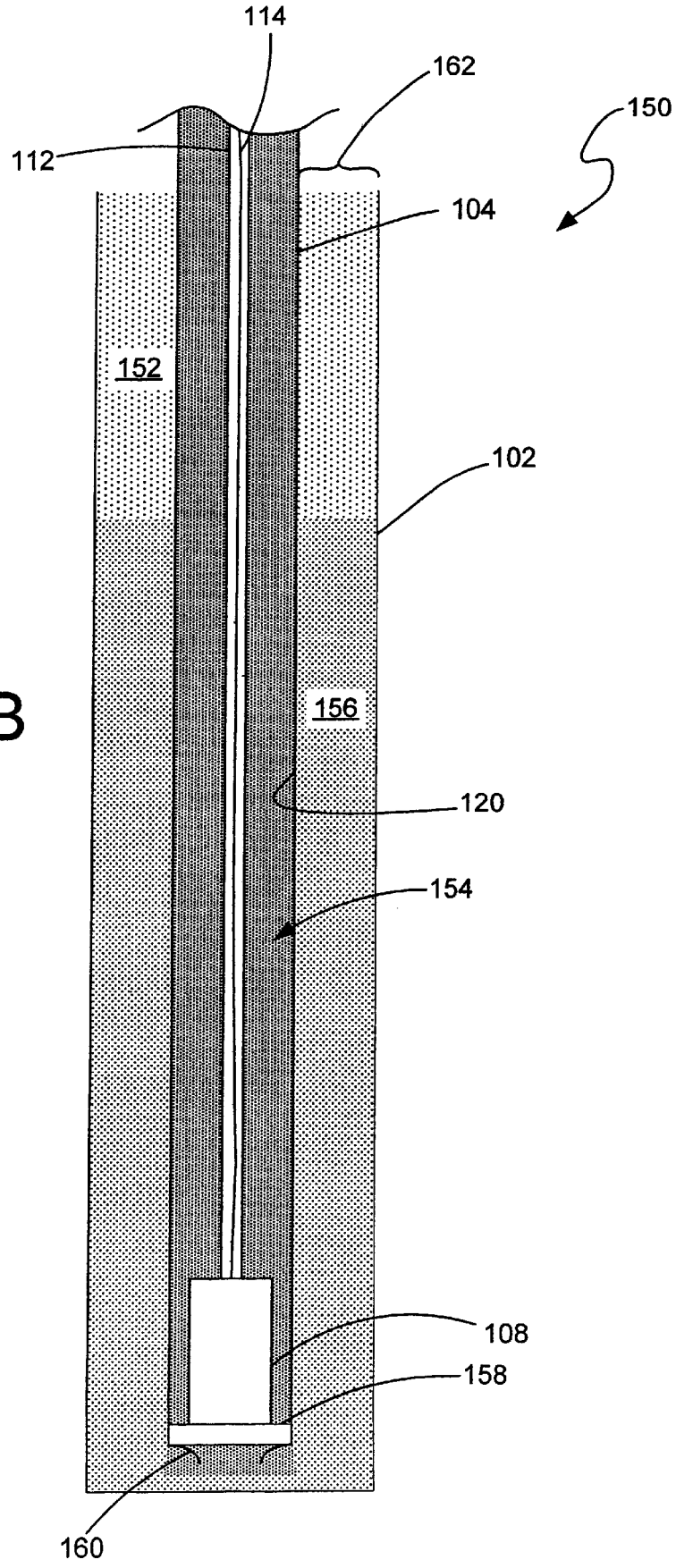
Figure 5C:
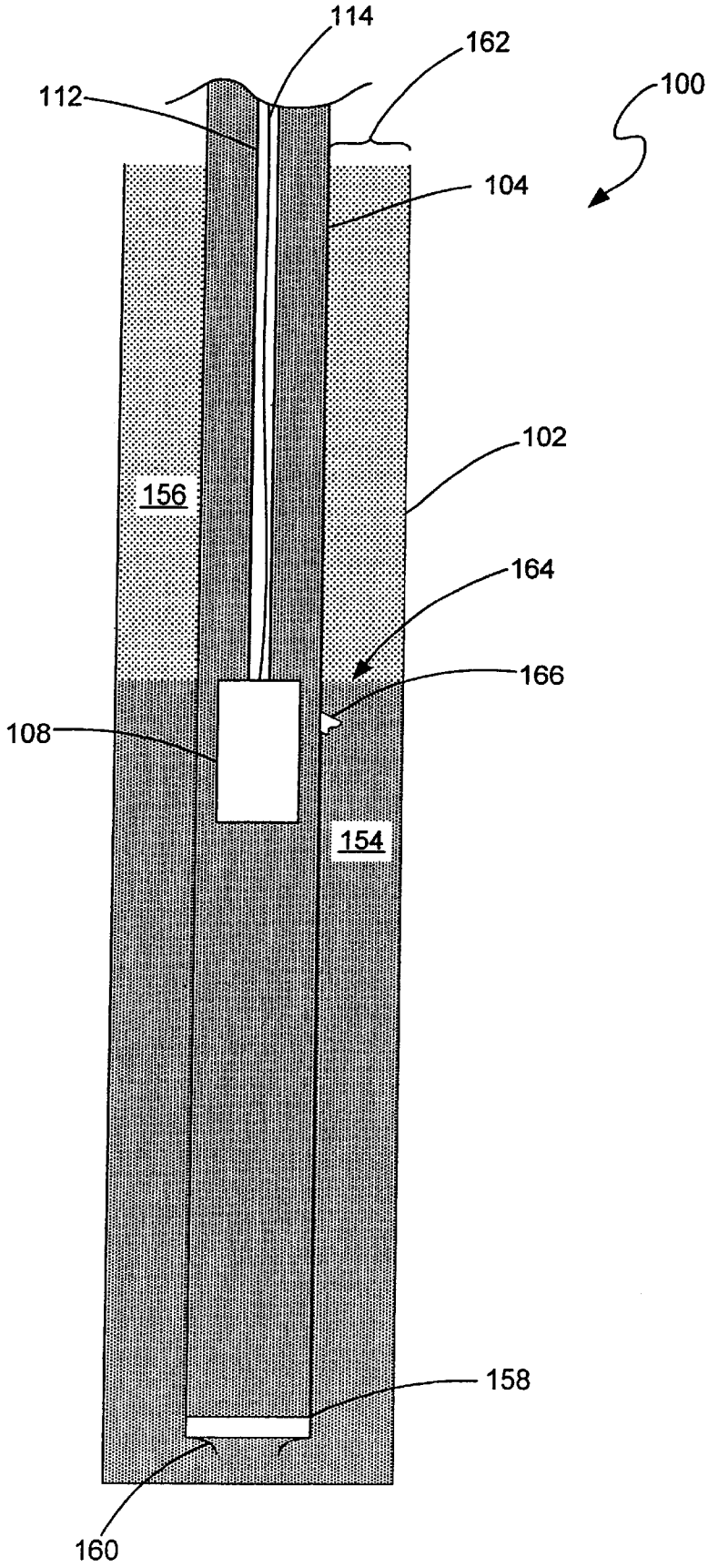

Referring now to FIGS. 5A through 5C, a drilling operation 150 is shown which incorporates another aspect of the present invention. As will be appreciated by those of skill in the art, a cementing operation is often conducted to complete the wellbore 102 prior to production of hydrocarbons. In performing the cementing operation, it is conventional to isolate the drilling mud 152, or some other fluid in the wellbore 102, from the cement slurry 154 being pumped down the interior of the tubing member 154 so as to avoid mixing possible contamination of the cement slurry 154. To isolate the drilling mud 152 from the cement slurry 154 a sufficient amount of spacer fluid 156 may be disposed therebetween. The rheology and density of the spacer fluid 156 are such that it causes displacement of the drilling fluid 152 into annulus 162 between tubular member 104 and the wall of wellbore 102 upon being displaced by the cement slurry 154.

One or more plugs 158 may be placed in the interior of the tubular member 104, which in this instance represents a casing member, as an additional barrier between the cement slurry 154 and the drilling mud 152. The plug 158 also serves to scrape or clean the interior wall 120 of the tubular member 104 as it traverses downwardly therethrough.

As seen in FIG. 5B, when the plug 158 reaches a predetermined point, for example, the bottom of the tubular member 104, the plug 158 stops its downward travel. However, the continued flow of cement slurry 154 builds pressure within the tubular member 104 causing a pressure sensitive diaphragm 160 formed within the plug 158 to rupture. The rupture of the diaphragm 160 allows the cement slurry 154 to flow therethrough and into the annulus 162 of the wellbore 102. The continued flow of the cement slurry 154 causes further displacement of the spacer fluid 156 and drilling mud 152 upwards through the annulus 162 formed between the tubular member 104 and the wellbore 102 and the cement slurry 154 eventually flows into the annulus 162 as well.

Referring to FIG. 5C, as the cement slurry 154 is displaced upwardly through the annulus 162, the vibrational source 108 may be drawn upwardly, for example, generally following the upper surface level 164 of the cement slurry 154 in the annulus 162. As the vibrational source 108 is being drawing upwardly it may operate in a manner similar to that described above in creating a fluid coupling with the cement slurry 154 within tubular member 104 (or some other displacement fluid which may follow the cement slurry 154) and transferring vibrational energy to the tubular member 104. The vibrational energy, due to the small amplitude motion of the tubular member 104, causes the cement slurry 154 within the annulus 162 to more completely settle, consolidate and fill the annulus 162. Additionally, using one or more sensors associated with the vibrational source (see FIG. 1) voids or pockets 166 formed within the cement slurry 154 in annulus 162 may be detected. For example, an accelerometer 126 (FIG. 1) may be used to monitor the motion amplitude associated with the vibrational source 108. The motion amplitude will vary when a void or pocket 166 is detected due to the lack of material in the area. Alternatively, an ultrasonic transducer may be employed to detect any voids or pockets 166 formed in the cement slurry 154 disposed in the annulus 162.

Upon detection of a void 166 the vibrational source 108 may be stopped at a location adjacent to the void 166 to transfer vibrational energy to the specific area containing the void 166. Further, if the void or pocket 166 remains after specific application of vibrational energy thereto, the frequency of the vibrational source 108 may be altered or continuously varied create harmonic vibrations in the tubular member 104 and to effect a greater response from the cement slurry 154.

Thus, the vibrational source 108 may be configured to not only transfer vibrational energy through a fluid coupling, thereby avoiding physical contact with the tubular member 104, but to also provide a means of monitoring and correcting any discontinuities within the cemented formation prior to curing thereof.

Further, if desired, the vibrational source 108 may be disposed within the tubular member 104 prior to the introduction of a cement slurry into the wellbore 162 so as to map out the formation of the wellbore 102. For example, the vibrational source may be deployed in the tubular member while only drilling mud is present in the tubular member 104 and the annulus 162 of the wellbore 102. Thus, the vibrational source may be used initially as a logging type tool by drawing it through the length of the tubular member 104 and recording the response of the wellbore 102 and drilling mud disposed in the annulus 162 to the vibrations induced by the vibrational source 108. After the wellbore 102 has been initially mapped out (i.e., with the drilling mud in the annulus 162), the vibrational source 108 may be used as described above to vibrate a cement slurry 154 disposed in the annulus 162. While vibrating the cement slurry 154, the response to the vibrational source 108 may again be recorded to map the wellbore 102 a second time. Upon mapping the wellbore 102 with the cement slurry 154 disposed within the annulus 162, the results may be compared to the initial mapping which is used as a benchmark.

Because drilling mud is conventionally less dense than the cement slurry 154, the initial mapping should only vary by constant factor to account for such a density change.

Additionally, the any of the above stated operations may be operated with multiple vibrational sources deployed down hole. For example, multiple vibrational sources may be phased so as to create a standing resonant wave. Alternatively, or in addition, phase shifts might be induced to as to create beat frequencies which may produce amplitudes large than through the use of a single vibrational source.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

We claim:

1. A method of inducing vibrational energy in a tubular member, the method comprising:

deploying an orbital mass vibrator within an interior portion of the tubular member;

disposing a fluid medium within an annulus formed between the orbital mass vibrator and an interior surface of the tubular member; and forming a fluid coupling between the orbital mass vibrator and tubular member through the fluid medium within the annulus including operating the orbital mass vibrator while substantially maintaining the annulus formed between the interior surface of the tubular member and the orbital mass vibrator so as to avoid substantial contact therebetween.

2. The method according to claim 1, further comprising monitoring a motion amplitude associated with the vibrational source.

3. The method according to claim 1, further comprising monitoring a pressure of the fluid medium.

4. The method according to claim 1, further comprising disposing the fluid medium in a bladder positioned within the annulus.

5. The method according to claim 1, further comprising locating the orbital mass vibrator at a predetermined position within the tubular member and inserting the tubular member in a well bore.

6. The method according to claim 5, further comprising powering the orbital mass vibrator with a battery pack.

7. The method according to claim 6, further comprising controlling the orbital mass vibrator by remote wireless telemetry.

8. The method according to claim 7, wherein the controlling the orbital mass vibrator by remote wireless telemetry includes propagating a coded pressure pulse through the fluid medium.

9. The method according to claim 7, wherein the controlling the orbital mass vibrator by remote wireless telemetry includes propagating an elastic wave signal through the tubular member.

10. The method according to claim 1, further comprising adjusting a frequency of the vibrational source in accordance with the monitored motion amplitude.

11. A method of removing a stuck tubular from a well bore, the method comprising:

disposing a vibrational source within the stuck tubular adjacent a point of sticking and in a spaced relationship with an interior surface of the stuck tubular;

forming a fluid coupling between the vibrational source and the stuck tubular through a fluid medium disposed within the stuck tubular; and transferring vibrational energy to the stuck tubular at least adjacent the point of sticking via the fluid coupling including substantially maintaining the spaced relationship of the vibrational source and the interior surface of the stuck tubular.

12. The method according to claim 11 further comprising monitoring a motion amplitude of the stuck tubular.

13. The method according to claim 11, further comprising monitoring the pressure of the fluid medium.

14. The method according to claim 11, wherein the forming a fluid coupling between the vibrational source and the stuck tubular through a fluid medium includes forming a fluid coupling between the vibrational source and the stuck tubular through drilling mud disposed within the stuck tubular.

15. The method according to claim 11, wherein forming a fluid coupling between the vibrational source and the stuck tubular through a fluid medium further comprises disposing a bladder in an annulus between the vibrational source and an interior surface of the stuck tubular and filling the bladder with the fluid medium.

16. The method according to claim 15, wherein filling the bladder with the fluid medium includes filling the bladder with glycerin.

17. The method according to claim 11, wherein forming a fluid coupling between the vibrational source and the stuck tubular is effected by orbital mass vibration of the vibrational source.

18. The method according to claim 11, wherein transferring vibrational energy to the stuck tubular includes inducing an orbital displacement motion within the stuck tubular about a longitudinal centerline taken along a length of the stuck tubular member.

19. A method of cementing a wellbore comprising:

inserting a tubular member within the well bore so as to define a first annulus between the wellbore and an exterior surface of the tubular member;

disposing a cement slurry into the first annulus;

disposing a vibrational source within the tubular member so as to define a second annulus between an exterior portion of the vibrational source and an interior surface of the tubular member;

forming a fluid coupling between the vibrational source and the tubular member through a fluid medium disposed in the second annulus;

transferring vibrational energy through the tubular member and into the cement slurry in the first annulus via the fluid coupling; and detecting a void in the cement slurry prior to a curing of the cement slurry.

20. The method according to claim 19, wherein disposing a cement slurry into the first annulus includes flowing the cement slurry through the tubular member and into the first annulus to define a rising surface of the cement slurry in the first annulus.

21. The method according to claim 20, further comprising moving the vibrational source upwardly through the tubular member such that the vibrational source maintains a proximity with the rising surface of the cement slurry.

22. The method according to claim 19, wherein detecting a void in the cement slurry prior to a curing of the cement slurry further includes detecting a response of the vibrational energy transferred to the cement slurry in the first annulus.

23. The method according to claim 22, further comprising transferring additional vibrational energy to the cement slurry at a location proximate the detected void.

24. The method according to claim 19 wherein the fluid medium comprises a portion of the cement slurry.

25. A method of inducing vibrational energy in a tubular member, the method comprising:

deploying a vibrational source within an interior portion of the tubular member;

disposing a fluid medium within an annulus formed between the vibrational source and an interior surface of the tubular member including disposing the fluid medium in a bladder positioned within the annulus; and forming a fluid coupling between the vibrational source and tubular member through the fluid medium within the annulus.

26. A method of removing a stuck tubular from a well bore, the method comprising:

disposing a vibrational source within the stuck tubular adjacent a point of sticking;

forming a fluid coupling between the vibrational source and the stuck tubular through a fluid medium disposed within the stuck tubular including disposing a bladder in an annulus between the vibrational source and an interior surface of the stuck tubular and filling the bladder with the fluid medium; and transferring vibrational energy to the stuck tubular at least adjacent the point of sticking via the fluid coupling.

* * * * *